US010299324B2

(12) United States Patent
Mun et al.

(10) Patent No.: US 10,299,324 B2
(45) Date of Patent: May 21, 2019

(54) LED LIGHTING APPARATUS

(71) Applicant: SILICON WORKS CO., LTD., Daejeon-si (KR)

(72) Inventors: Gyeong Sik Mun, Daejeon-si (KR); Sang Young Lee, Jeonju-si (KR); Ki Chul An, Daegu-si (KR); Yong Geun Kim, Suwon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 72 days.

(21) Appl. No.: 14/792,937

(22) Filed: Jul. 7, 2015

(65) Prior Publication Data

US 2016/0014859 A1 Jan. 14, 2016

(30) Foreign Application Priority Data

Jul. 9, 2014 (KR) ..... 10-2014-0085937
Dec. 10, 2014 (KR) ..... 10-2014-0177379

(51) Int. Cl.
*H05B 37/02* (2006.01)
*H05B 33/08* (2006.01)

(52) U.S. Cl.
CPC ..... *H05B 33/0824* (2013.01); *H05B 33/083* (2013.01); *H05B 33/0842* (2013.01)

(58) Field of Classification Search
CPC ..... H05B 33/0824; H05B 33/08; H05B 37/02
USPC ..... 315/185 R, 186, 192
See application file for complete search history.

(56) References Cited

U.S. PATENT DOCUMENTS 8,686,651 B2 * 4/2014 Lynch ..... H05B 33/0818 315/192
9,173,265 B2 * 10/2015 Park ..... H05B 33/0824
9,386,644 B2 * 7/2016 Moon ..... H05B 33/0824
9,653,018 B2 * 5/2017 Kim ..... H05B 33/0815
2008/0224025 A1 * 9/2008 Lyons ..... G01J 1/32 250/205
2010/0194298 A1 * 8/2010 Kuwabara ..... H05B 33/083 315/186
2010/0207546 A1 * 8/2010 Jung ..... H05B 33/0818 315/297
2010/0308738 A1 * 12/2010 Shteynberg ..... H05B 33/0812 315/185 R
2011/0273103 A1 * 11/2011 Hong ..... H05B 33/0809 315/193
2013/0187572 A1 7/2013 Grajcar
2013/0320868 A1 * 12/2013 Kim ..... H05B 33/0824 315/186

(Continued)

FOREIGN PATENT DOCUMENTS

JP 2013-502081 1/2013
KR 10-2012-0079831 7/2012
KR 10-2014-0041224 4/2014

*Primary Examiner* — Crystal L Hammond
*Assistant Examiner* — Jonathan G Cooper
(74) *Attorney, Agent, or Firm* — Kile Park Reed & Houtteman PLLC

(57) ABSTRACT

Provided is a lighting apparatus. The lighting apparatus may include two or more lighting units each including a plurality of LED groups which sequentially emit light in response to changes of a rectified voltage. The two or more lighting units may include one or more LED groups having the same light emitting sequence but having different light emitting points of time. Thus, current harmonic can be reduced, and power efficiency can be improved.

13 Claims, 7 Drawing Sheets

(56) References Cited

U.S. PATENT DOCUMENTS

| | | | | |
|---|---|---|---|---|
| 2014/0042918 | A1* | 2/2014 | Lee | H05B 33/0809<br>315/185 R |
| 2014/0292213 | A1* | 10/2014 | Yoon | H05B 33/0821<br>315/192 |

* cited by examiner

LED LIGHTING APPARATUS

BACKGROUND

1. Technical Field

The present disclosure relates to a lighting apparatus, and more particularly, to a lighting apparatus capable of improving current harmonic.

2. Related Art

In order to reduce energy, a lighting apparatus is designed to use a light source having high light emission efficiency based on a small amount of energy. Representative examples of a light source used in the lighting apparatus may include an LED.

The LED is differentiated from other light sources in terms of various aspects such as energy consumption, lifetime, and light quality. Since the LED is driven by a current, a lighting apparatus using the LED as a light source requires a large number of additional circuits for current driving.

In order to solve the above-described problem, an AC direct-type lighting apparatus has been developed to provide an AC voltage to the LED. The lighting apparatus is configured to convert an AC voltage into a rectified voltage, and control the LED to emit light through current driving using the rectified voltage. Since the lighting apparatus directly uses a rectified voltage without using an inductor and capacitor, the lighting apparatus has a satisfactory power factor. The rectified voltage indicates a voltage obtained by full-wave rectifying an AC voltage through a rectifier.

The lighting apparatus may be non-linearly driven in an AC-direct type. Thus, there may be problem with current harmonic. The current harmonic may reduce the power efficiency of the lighting apparatus.

Thus, there is a demand for a method capable of reducing current harmonic and improving power efficiency.

PRIOR ART DOCUMENT

Patent Document

Korean Patent Publication No. 10-2012-0079831 (titled "Spectral shift control for dimmable AC LED lighting").

SUMMARY

Various embodiments are directed to a technology which drives a lighting apparatus including LEDs according to an AC direct method, and improves current harmonic to increase power efficiency.

Also, various embodiments are directed to a lighting apparatus which includes LEDs and is capable of improving current harmonic caused by non-linear driving.

In an embodiment, a lighting apparatus may include: two or more lighting units each including a plurality of LED groups which sequentially emit light in response to changes of a rectified voltage; and two or more driving circuits corresponding the two or more lighting units, respectively, and configured to regulate driving currents of the lighting units. One or more LED groups having the same light emitting sequence in the two or more lighting units may have different light emitting points of time.

DETAILED DESCRIPTION

Figure 1:
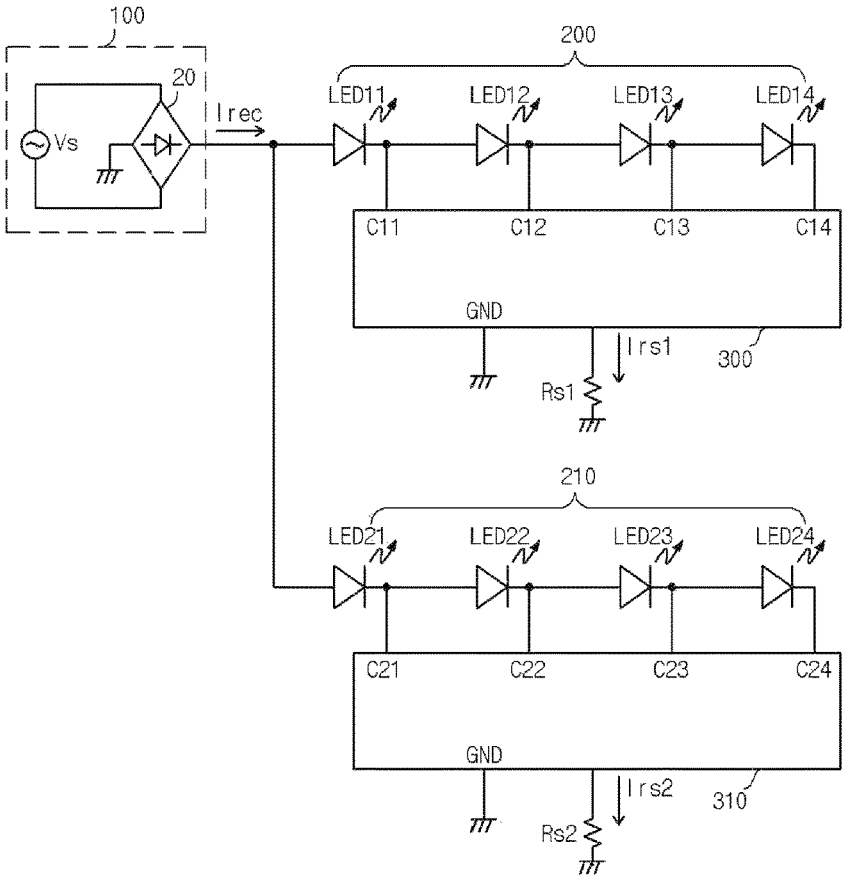
FIG. 1 is a circuit diagram of a lighting apparatus in accordance with an embodiment of the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

A lighting apparatus in accordance with an embodiment of the present invention may use a light source based on the light emitting characteristic of a semiconductor which converts electrical energy into light energy, and the light source based on the light emitting characteristic of semiconductor may include an LED.

The embodiments of the present invention may be disclosed through a lighting apparatus which is driven in an AC-direct type as illustrated in FIG. 1. The lighting apparatus of FIG. 1 may include a light source to emit light using an AC voltage, and perform current regulation for regulating a current in response to the light emission of the light source.

Referring to FIG. 1, the lighting apparatus in accordance with the embodiment of the present invention will be described. The lighting apparatus in accordance with the embodiment of the present invention may include a power supply circuit 100, lighting units 200 and 210, driving units 300 and 310, and current sensing resistors Rs1 and Rs2.

In the above configuration, the power supply circuit 100 may provide rectified power, the lighting units 200 and 210 may emit light using the rectified power, and the driving unit 300 and 310 may perform current regulation for regulating a current corresponding to the light emission of the lighting units 200 and 210 and provide a current path for light emission. The current sensing resistors Rs1 and Rs2 may provide a current path, and provide a sensing voltage for the current regulation of the driving units 300 and 310.

The power supply circuit 100 may include a power supply Vs and a rectifier circuit 20. The power supply Vs may be a commercial AC power supply to provide AC power.

The rectifier circuit 20 may convert a negative voltage of an AC voltage into a positive voltage. That is, the rectifier circuit 20 may full-wave rectify an AC voltage having a sine-waveform of AC power provided from the AC power supply Vs, and output the rectified voltage. The rectified voltage may have a ripple in which the voltage level thereof rises and falls on a basis of the half cycle of a commercial AC voltage. In the embodiment of the present invention, the change (rise or fall) of the rectified voltage may indicate the rise or fall in ripple of the rectified voltage.

The power supply circuit 100 may include a dimmer (not illustrated) to control brightness. The dimmer may control the phase of the AC voltage provided from the rectifier circuit 20. Through the phase control of the dimmer, the amount of entire driving current provided to the lighting units 200 and 210 can be controlled. As a result, the brightness of the lighting apparatus can be controlled.

In the embodiment of the present invention, the lighting units 200 and 210 including light sources may emit light using the rectified voltage provided from the rectifier circuit 20. The entire driving current provided from the rectifier circuit may be represented by Irec, and driving currents divided from the entire driving current Irec and provided to the lighting units 200 and 210 may be represented by Irs1 and Irs2, respectively. The driving currents provided to the lighting units 200 and 210 may be equal to currents flowing through the respective current sensing resistors Rs1 and Rs2.

Each of the lighting units 200 and 210 may include a plurality of LEDs, and the plurality of LEDs may be divided into a plurality of groups and sequentially turned on or off. In FIG. 1, the lighting units 200 and 210 may be divided into four LED groups LED11 to LED14 and four LED groups LED21 to LED24, respectively. Each of the LED groups LED11 to LED14 and LED21 to LED24 may include one or more LEDs. In FIG. 1, each of the LED groups LED11 to LED14 and LED21 to LED24 is represented by one symbol, for convenience of description.

Each of the lighting units 200 and 210 may include a driving circuit. The driving circuit corresponding to the lighting unit 200 may include a driving unit 300 and a current sensing resistor Rs1, and the driving circuit corresponding to the lighting unit 210 may include a driving unit 310 and a current sensing resistor Rs2.

The driving units 300 and 310 may regulate a driving current, and induce a flow of constant current in response to light emission of the lighting units 200 and 210. For this operation, the driving units 300 and 310 may perform current regulation for light emission of the LED groups LED11 to LED14 and LED21 to LED24, and provide a current path for light emission with the current sensing resistors Rs1 and Rs2 of which one ends are grounded.

In the embodiment of FIG. 1, the LED groups LED11 to LED14 and LED21 to LED24 of the lighting units 200 and 210 may be sequentially turned on or off in response to rises or falls of the rectified voltage.

The driving units 300 and 310 may provide a current path for light emission, when the rectified voltage increases to sequentially reach the light emitting voltages of the respective LED groups LED11 to LED14 and LED21 to LED24.

A light emitting voltage V14 at which the LED group LED14 emits light may be defined as the voltage at which all of the LED groups LED11 to LED14 emit light. A light emitting voltage V13 at which the LED group LED3 emits light may be defined as the voltage at which the LED groups LED1 to LED3 emit light. A light emitting voltage V12 at which the LED group LED12 emits light may be defined as the voltage at which the LED groups LED11 to LED12 emit light. A light emitting voltage V11 at which the LED group LED11 emits light may be defined as the voltage at which only the LED group LED11 emits light.

Furthermore, a light emitting voltage V24 at which the LED group LED24 emits light may be defined as the voltage at which all of the LED groups LED21 to LED24 emit light. A light emitting voltage V23 at which the LED group LED23 emits light may be defined as the voltage at which the LED groups LED21 to LED23 emit light. A light emitting voltage V22 at which the LED group LED22 emits light may be defined as the voltage at which the LED groups LED21 and LED22 emit light. A light emitting voltage V21 at which the LED group LED21 emits light may be defined as the voltage at which only the LED group LED21 emits light.

The driving units 300 and 310 may receive sensing voltages from the current sensing resistors Rs1 and Rs2. The sensing voltages may be varied by a current path formed at a variable position within the driving units 300 and 310 according to the light emitting states of the respective LED groups in the lighting units 200 and 210. At this time, the current flowing through the current sensing resistors Rs and Rs2 may include a constant current.

In the above configuration, one or more pairs of LED groups having the same light emitting sequence in the lighting units 200 and 210 may have different light emitting points of time. In the lighting units 200 and 210 in accordance with the embodiment of the present invention, the LED group LED11 and the LED group LED21 may have the same light emitting sequence, the LED group LED12 and the LED group LED22 may have the same light emitting sequence, the LED group LED13 and the LED group LED23 may have the same light emitting sequence, and the LED group 14 and the LED group LED24 may have the same light emitting sequence.

In the embodiment of the present invention, one or more pairs of LED groups among the LED groups having the same light emitting sequence may be configured to have different light emitting points of time.

The pair of LED groups having the same light emitting sequence but having different light emitting points of time may be configured to emit light in response to different light emitting voltages having a difference of at least 10% or more.

Furthermore, the pair of LED groups having the same light emitting sequence but having different light emitting points of time may be configured to emit light in response to different phases of the rectified voltage, which have a difference of at least 10% or more.

The entire light emitting voltages of the respective lighting units 200 and 210 may be set to have a difference smaller than 20% based on the entire light emitting voltage of any one lighting unit.

The lighting units 200 and 210 may be configured in such a manner that the pair of LED groups having the last light emitting sequence has substantially the same light emitting point of time, and the other pairs of LED groups have different light emitting points of time.

For this operation, the LED groups LED11 and LED21 which first emit light in the lighting units 200 and 210 may include different numbers of LEDs connected in series.

Figure 2A:
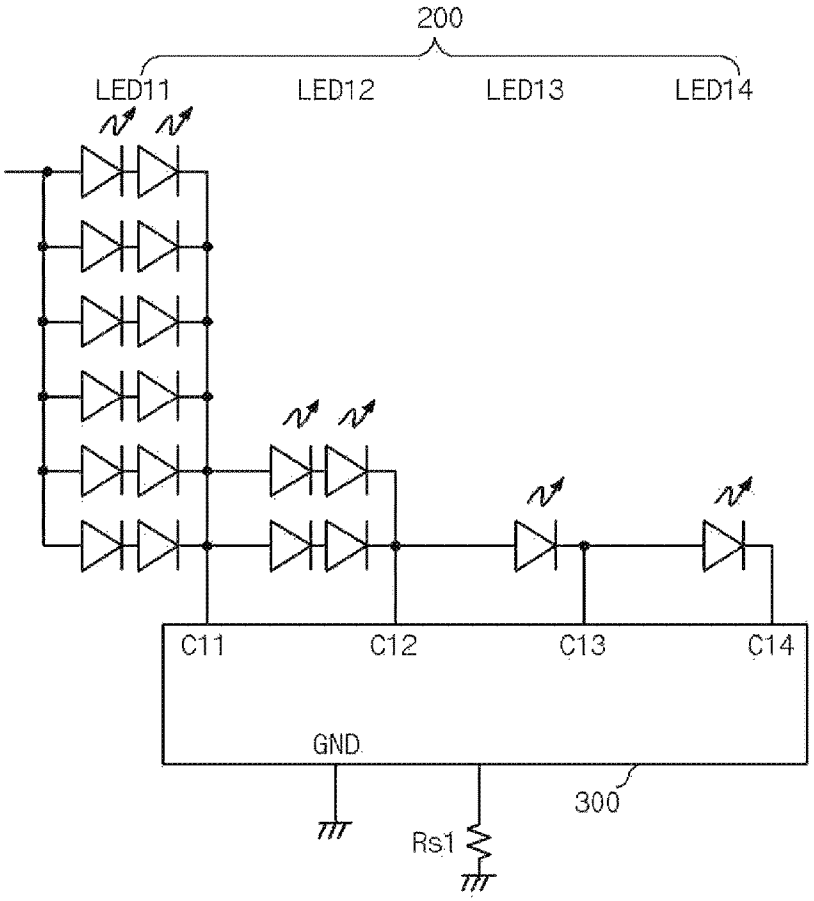
FIG. 2A is a circuit diagram illustrating an example of a lighting unit 200 of FIG. 1.
Figure 2B:
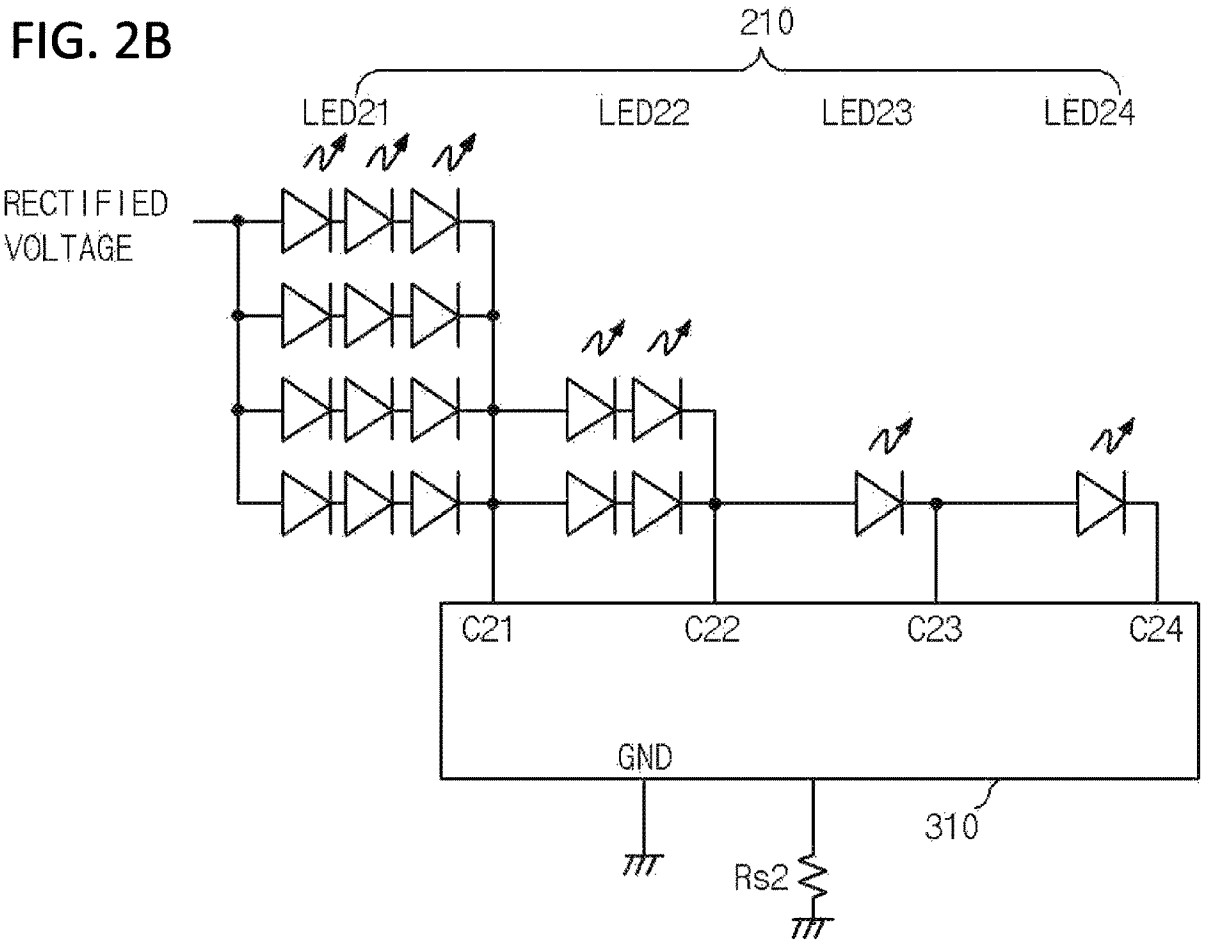
FIG. 2B is a circuit diagram illustrating an example of a lighting unit 210 of FIG. 1.

Referring to FIGS. 2A and 2B, the LED group LED11 of the lighting unit 200 may include two LEDs connected in series, and the LED group LED21 of the lighting unit 210 may include three LEDs connected in series. The LED group LED12 of the lighting unit 200 and the LED group LED22 of the lighting unit 210 may include two LEDs connected in series, and the LED groups LED13 and LED14 of the lighting unit 200 and the LED groups LED23 and LED24 of the lighting unit 210 may include one LED. At this time, each of the LED groups LED11, LED12, LED21, and LED22 may be configured to include a plurality of rows connected in parallel.

As illustrated in FIGS. 2A and 2B, the LED groups LED12, LED13, and LED14 of the lighting unit 200 may include the same number of LEDs as the LED groups LED22, LED23, and LED24 of the lighting unit 210, respectively.

Furthermore, the LED group LED21 of the lighting unit 210 may include a larger number of LEDs connected in series than the LED group LED11 of the lighting unit 200. That is, the LED group LED21 of the lighting unit 210 may have a higher light emitting voltage than the LED group LED11 of the lighting unit 200. As a result, the LED group LED21 may emit light at a light emitting point of time later than the LED group LED11. Furthermore, the numbers of LEDs connected in parallel may be adjusted so that the LED group LED21 of the lighting unit 210 and the LED group LED11 of the lighting unit 200 include the same number of LEDs.

As the pair of LED groups LED11 and LED21 has different light emitting points of time, the LED groups LED12 and LED22 and the LED groups LED13 and LED23 may have different light emitting points of time.

In the embodiment of the present invention, the LED group LED24 may be configured to have a lower light emitting voltage than the LED group LED14 such that the LED groups LED14 and LED24 have the same light emitting point of time. More specifically, the LED group LED11 may be configured to have a lower light emitting voltage than the light emitting voltage of the LED group LED21 by a difference in light emitting voltage therebetween. Thus, the LED group LED14 and the LED group LED24 may have the same light emitting point of time.

The configuration and operation of the driving units 300 and 310 for driving the lighting units 200 and 210 will be described in detail with reference to FIG. 3. Representatively, the driving unit 300 will be taken as an example for description. Since the driving unit 310 can be configured in the same manner as the driving unit 300, the duplicate descriptions thereof are omitted herein.

Figure 3:
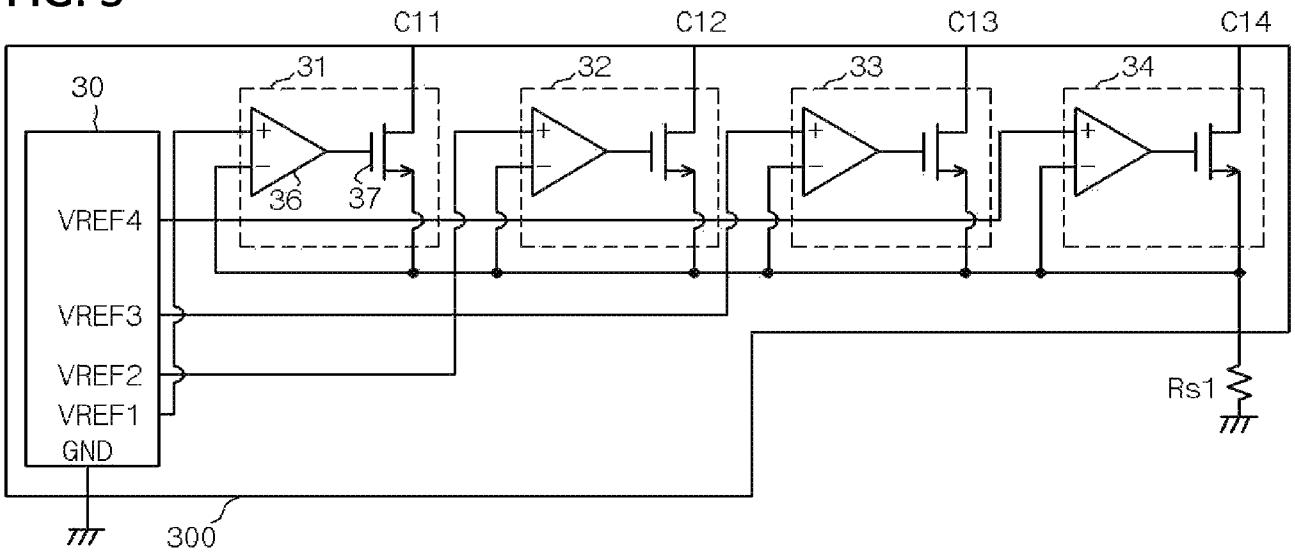
FIG. 3 is a detailed circuit diagram of a driving circuit of FIG. 1.

As illustrated in FIG. 3, the driving unit 300 may include a plurality of switching circuits 31 to 34 and a reference voltage supply unit 30, which can be implemented as one chip. The plurality of switching circuits 31 to 34 may be configured to provide a current path for the LED groups LED1 to LED4, and the reference voltage supply unit 30 may be configured to provide reference voltages VREF1 to VREF4.

The reference voltage supply unit 30 may be configured to provide the reference voltages VREF1 to VREF4 having different levels according to a designer's intention.

The reference voltage supply unit 30 may include a plurality of resistors which are connected in series so as to receive a constant voltage, and output the reference voltages VREF1 to VREF4 having different levels to nodes among the resistors, respectively. In another embodiment, the reference voltage supply unit 30 may include independent voltage supply sources for providing the reference voltages VREF1 to VREF4 having different levels.

In FIG. 3, GND represents the ground, and the ground GND may be commonly applied to the reference voltage supply unit 30 and the current sensing resistor Rs. In the reference voltage supply unit 30, the ground GND may be applied to the plurality of resistors connected in series to output the reference voltages VREF1 to VREF4 having different levels.

Among the reference voltages VREF1 to VREF4 having different levels, the reference voltage VREF1 may have the lowest voltage level, and the reference voltage VREF4 may have the highest voltage level.

The reference voltage VREF1 may have a level for turning off the switching circuit 31 at the point of time that the LED group LED12 emits light. More specifically, the reference voltage VREF1 may be set to a lower level than the sensing voltage which is formed in the current sensing resistor Rs1 in response to light emission of the LED group LED12.

The reference voltage VREF2 may have a level for turning off the switching circuit 32 at the point of time that the LED group LED13 emits light. More specifically, the reference voltage VREF2 may be set to a lower level than the sensing voltage which is formed in the current sensing resistor Rs1 in response to light emission of the LED group LED13.

The reference voltage VREF3 may have a level for turning off the switching circuit 33 at the point of time that the LED group LED14 emits light. More specifically, the reference voltage VREF3 may be set to a lower level than the sensing voltage which is formed in the current sensing resistor Rs1 in response to light emission of the LED group LED14.

Furthermore, the reference voltage VREF4 may be set in such a manner that a current path through the switching circuit 34 is maintained in the upper limit-level region of the rectified voltage.

The switching circuits 31 to 34 may be commonly connected to the sensing resistor Rs1 which provides a sensing voltage for performing current regulation and forming a current path.

The switching circuits 31 to 34 may compare the sensing voltage of the current sensing resistor Rs1 to the reference voltages VREF1 to VREF4 of the reference voltage supply unit 30, and form a selective current path for turning on the lighting unit 200.

The switching circuits 31 to 34 of the driving unit 300 may induce a regulated flow of constant current in response to light emissions of the respective LED groups LED11 to LED14, and perform current regulation so as not to exceed a preset current in response to sequential light emissions of the respective LED groups LED11 to LED14.

That is, each of the switching circuits 31 to 34 may not perform a current regulation operation on a driving current less than the regulated current value set therein, but perform a current regulation operation on a driving current equal to or more than the regulated current value set therein such that the driving current does not exceed the regulated level.

Each of the switching circuits 31 to 34 may receive a high-level reference voltage as the switching circuit is connected to an LED group remote from the position to which the rectified voltage is applied.

Each of the switching circuits 31 to 34 may include a comparator 36 and a switching element 37, and the switching element 37 may include an NMOS transistor.

The comparator 36 included in each of the switching circuits 31 to 34 may have a positive input terminal (+) configured to receive a reference voltage, a negative input terminal (−) configured to receive a sensing voltage, and an output terminal configured to output a result obtained by comparing the reference voltage and the sensing voltage.

The switching element 37 included in each of the switching circuits 31 to 34 may perform a switching operation according to the output of the comparator 36, which is applied through the gate thereof.

The operation of the driving unit 300 of FIG. 3 will be described with reference to FIG. 4.

Figure 4:
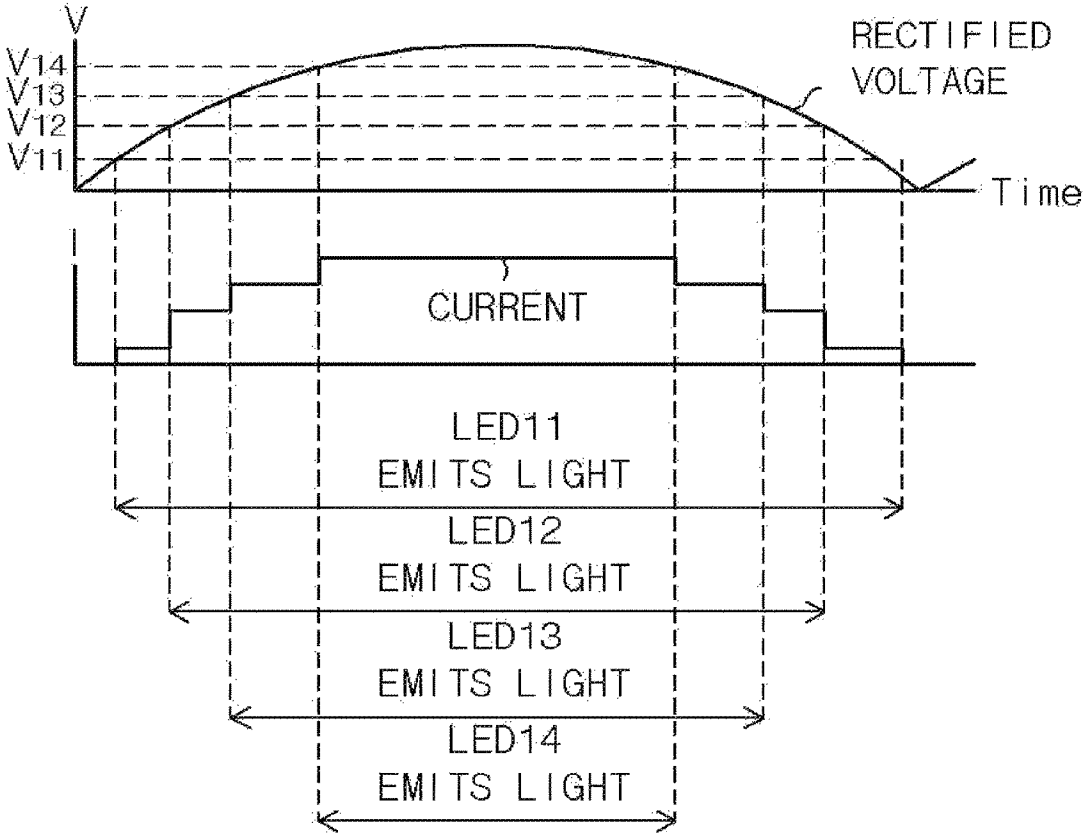
FIG. 4 is a graph for describing the operation of each driving unit of FIG. 1.

The power supply circuit 100 may provide a rectified voltage corresponding to AC power to the lighting unit 200, and the rectified voltage may be provided as illustrated in FIG. 4.

When the rectified voltage is in the initial state, the switching circuits 31 to 34 may maintain a turned-on state because the reference voltages VREF1 to VREF4 applied to the positive input terminals (+) thereof are higher than the sensing voltage of the current sensing resistor Rs1, which is applied to the negative input terminals (−) thereof. At this time, a driving current flowing in the switching circuit 31 may be equal to or less than the current value regulated by the switching circuit 31. Thus, the switching circuit 31 may not regulate the driving current flowing therein. That is, the switching circuit 31 may not perform a current regulation operation.

Then, when the rectified voltage rises to reach the light emitting voltage V1, the LED group LED1 of the lighting unit 200 may emit light. Then, when the LED group LED11 emits light, the switching circuit 31 of the driving unit 300 connected to the LED group LED11 may provide a current path.

When the rectified voltage reaches the light emitting voltage V11 such that the LED group LED11 emits light and a current path is formed through the switching circuit 31, the level of the sensing voltage of the current sensing resistor Rs1 may rise. However, since the level of the sensing voltage is low, the turn-on states of the switching circuits 31 to 34 may not be changed. At this time, a driving current flowing through the switching circuit 31 may be regulated by the current regulation operation of the switching circuit 31.

Then, the rectified voltage may rise over the light emitting voltage V11. At this time, since a driving current flowing through the switching circuit 32 is less than the current value regulated by the switching circuit 32, the switching circuit 32 may not regulate the driving current flowing therein. That is, the current regulation operation by the switching circuit 31 may be performed, and the current regulation operation by the switching circuit 32 may not be performed.

Then, when the rectified voltage continuously rises to reach the light emitting voltage V12, the LED group LED12 of the lighting unit 200 may emit light. When the LED group LED12 emits light, the switching circuit 32 of the driving unit 300 connected to the LED group LED12 may provide a current path. At this time, the LED group LED11 may also maintain the light emitting state.

When the rectified voltage reaches the light emitting voltage V12 such that the LED group LED12 emits light and the current path is formed through the switching circuit 32, the level of the sensing voltage of the current sensing resistor Rs1 may rise. At this time, the sensing voltage may have a higher level than the reference voltage VREF1. Therefore, the switching element 37 of the switching circuit 31 may be turned off by an output of the comparator 36. That is, the switching circuit 31 may be turned off, and the switching circuit 32 may provide a selective current path corresponding to the light emission of the LED group LED12. At this time, a driving current flowing through the switching circuit 32 may be regulated by the current regulation operation of the switching circuit 32.

Then, when the rectified voltage continuously rises to reach the light emitting voltage V13, the LED group LED13 of the lighting unit 200 may emit light. When the LED group LED13 emits light, the switching circuit 33 of the driving unit 300 connected to the LED group LED13 may provide a current path. At this time, the LED groups LED11 and LED12 may also maintain the light emitting state.

When the rectified voltage reaches the light emitting voltage V13 such that the LED group LED13 emits light and the current path is formed through the switching circuit 33, the level of the sensing voltage of the current sensing resistor Rs1 may rise. At this time, the sensing voltage may have a higher level than the reference voltage VREF2. Therefore, the switching element 37 of the switching circuit 32 may be turned off by an output of the comparator 36. That is, the switching circuit 32 may be turned off, and the switching circuit 33 may provide a selective current path corresponding to the light emission of the LED group LED13. At this time, a driving current flowing through the switching circuit 33 may be regulated by the current regulation operation of the switching circuit 33.

Then, when the rectified voltage reaches the light emitting voltage V14, the LED group LED14 of the lighting unit 200 may emit light. When the LED group LED14 emits light, the switching circuit 34 of the driving unit 300 connected to the LED group LED14 may provide a current path. At this time, the LED groups LED11 to LED13 may also maintain the light emitting state.

When the rectified voltage reaches the light emitting voltage V14 such that the LED group LED14 emits light and the current path is formed through the switching circuit 34, the level of the sensing voltage of the current sensing resistor Rs1 may rise. At this time, the sensing voltage may have a higher level than the reference voltage VREF3. Therefore, the switching element 37 of the switching circuit 33 may be turned off by an output of the comparator 36. That is, the switching circuit 33 may be turned off, and the switching circuit 34 may provide a selective current path corresponding to the light emission of the LED group LED14. At this time, a driving current flowing through the switching circuit 34 may be regulated by the current regulation operation of the switching circuit 34.

Then, the rectified voltage may rise over the light emitting voltage V14. At this time, the switching circuit 34 may regulate the driving current flowing therein. Then, although the rectified voltage continuously rises, the switching circuit 34 may maintain the turn-on state such that the driving current formed in the current sensing resistor Rs1 becomes a predetermined constant current in the upper limit-level region of the rectified voltage.

As described above, when the LED groups LED11 to LED14 sequentially emit light in response to the rises of the rectified voltage, the driving current on the current path may also increase in a stepwise manner so as to have a stepped current waveform as illustrated in FIG. 4.

The driving unit 300 may perform a constant current regulation operation as described above. Thus, the driving current corresponding to light emission of each LED group may maintain a predetermined level. When the number of LED groups to emit light increases, the level of the driving current may rise in response to the increase in number of LED groups.

After rising to the upper limit level as described above, the rectified voltage may start to fall. When the rectified voltage falls below the light emitting voltage V14, the LED group LED14 of the lighting unit 200 may be turned off.

When the LED group LED14 is turned off, the lighting unit 200 may maintain the light emitting state using the LED groups LED13, LED12, and LED11. Thus, a current path may be formed by the switching circuit 33 connected to the LED group LED13.

Then, when the rectified voltage sequentially falls below the light emitting voltages V13, V12, and V11, the LED groups LED13, LED12, and LED11 of the lighting unit 200 may be sequentially turned off.

As the LED groups LED13, LED12, and LED11 of the lighting unit 200 are sequentially turned off, the driving unit 300 may shift and provide a selective current path formed by the switching circuits 33, 32, and 31. Furthermore, in response to the turn-off states of the LED groups LED11, LED12, and LED13, the driving current on the current path may also decrease in a stepwise manner so as to have a stepped current waveform.

The lighting unit 210 may be sequentially turned on/off in response to the rises/falls of the rectified voltage, like the operation of the lighting unit 200. In response to the turns-on/off of the lighting unit 210, the driving unit 310 may also shift and provide a current path in response to light emission.

At this time, a part of the LED groups of the lighting unit 210 may have a different light emitting point of time from LED groups having the same light emitting sequence in the lighting unit 200. Thus, the lighting units 200 and 210 may be operated in such a manner that the numbers of LED groups emitting light in response to a rise of the rectified voltage alternately and sequentially increase. Furthermore, the driving units 300 and 310 may regulate the driving currents such that the current change points thereof have different stepped current waveforms in response to light emissions of the respective units 200 and 210.

In the embodiment of the present invention, each of the lighting units 200 and 210 may include four LED groups. The LED groups excluding the LED group which finally emits light may be configured to have different light emitting points of time for the light emitting sequences thereof.

This configuration will be described in more detail.

The voltage at which the entire LED groups LED11 and LED14 included in the lighting unit 200 emit light may be defined as the entire light emitting voltage of the lighting unit 200, and the entire light emitting voltage of the lighting unit 200 may correspond to the light emitting voltage V14. The voltage at which the entire LED groups LED21 and LED24 included in the lighting unit 210 emit light may be defined as the entire light emitting voltage of the lighting unit 210, and the entire light emitting voltage of the lighting unit 210 may correspond to the light emitting voltage V24.

In this case, the entire light emitting voltage of any one lighting unit may be set to be lower by 20% than the entire light emitting voltage of the other lighting unit.

Based on the sequential light emitting sequences of the lighting units 200 and 210, the light emitting sequences of the LED groups LED11 and LED21 may correspond to each other, the light emitting sequences of the LED groups LED12 and LED22 may correspond to each other, the light emitting sequences of the LED groups LED13 and LED23 may correspond to each other, and the light emitting sequences of the LED groups LED14 and LED24 may correspond to each other.

Furthermore, the LED groups LED11 to LED13 of the lighting unit 200 and the LED groups LED21 to LED23 of the lighting unit 210 may have light emitting voltages having the same potential difference for the respective LED groups having the corresponding light emitting sequence. The difference between the light emitting voltages may be determined by the LEDs connected in series in the LED group LED21, and the light emitting voltages of the LED groups having the same light emitting sequence may be formed to have a difference of 10% or more.

More specifically, the LED groups LED11 to LED13 of the lighting unit 200 and the LED groups LED21 to LED23 of the lighting unit 210 may be configured to have light emitting voltages having a potential difference of 64V for the respective channels, and the LED group LED21 may be configured to have a light emitting voltage higher by 32V than the LED group LED11.

In the lighting unit 200, the light emitting voltage V11 may be set to 64V, the light emitting voltage V12 may be set to 128V, the light emitting voltage V13 may be set to 192V, and the light emitting voltage V14 may be set to 256V. That is, the potential difference between the respective groups may be set to 64V. In the lighting unit 210, the light emitting voltage V21 may be set to 96V, the light emitting voltage V22 may be set to 160V, and the light emitting voltage V23 may be set to 224V. However, the light emitting voltage V24 of the LED group LED24 which finally emits light in the lighting unit 210 may be set to substantially the same voltage as the light emitting voltage V14 of the LED group LED14 which finally emits light in the lighting unit 200. For this configuration, the light emitting voltage V24 may be set to 256V, and a potential difference in light emitting voltage between the LED group LED23 and the LED group LED24 may be set to 32V.

As the light emitting voltages are set as described above, the LED group LED11 may emit light when the rectified voltage rises to reach 64V corresponding to the light emitting voltage V11, the LED group LED21 may further emit light when the rectified voltage rises to reach 96V corresponding to the light emitting voltage V21, the LED group LED12 may further emit light when the rectified voltage reaches 128V corresponding to the light emitting voltage V12, the LED group LED22 may further emit light when the rectified voltage reaches 160V corresponding to the light emitting voltage V22, the LED group LED13 may further emit light when the rectified voltage reaches 192V corresponding to the light emitting voltage V13, the LED group LED23 may further emit light when the rectified voltage reaches 224V corresponding to the light emitting voltage V23, and the LED groups LED14 and LED24 may further emit light when the rectified voltage reaches 256V corresponding to the light emitting voltages V14 and V24.

That is, the number of LED groups to emit light in the lighting unit 200 and the number of LED groups to emit light in the lighting unit 210 may alternately and sequentially increase.

In response to the light emissions of the lighting units 200 and 210, the driving units 300 and 310 may perform current regulation to regulate driving currents corresponding to the light emissions of the respective lighting units 200 and 210 such that the current change points thereof have different stepped current waveforms.

The driving units 300 and 310 may regulate the driving currents by performing current regulation corresponding to the light emissions of the respective lighting units 200 and 210. The driving current corresponding to the light emission of the lighting unit 200 and regulated by the driving unit 300 may have a stepped current waveform as indicated by Irs1, and the driving current corresponding to the light emission of the lighting unit 210 and regulated by the driving unit 310 may have a stepped current waveform as indicated by Irs2.

The lighting units 200 and 210 and the driving units 300 and 310 may serve as loads from the viewpoint of the power supply circuit 100, and a current supplied to the loads, that is, the entire driving current Irec supplied to the lighting units 200 and 210 may have a stepped current waveform obtained by adding the driving current Irs1 and the driving current Irs2.

That is, the entire driving current Irec may have a plurality of constant current periods, and the constant current periods may be divided according to (number of LED groups*number of lighting units)−(number of lighting units−1). For this configuration, the LED groups which finally emit light in the respective lighting units 200 and 210 may have substantially the same light emitting voltage to form the same constant current section.

The lighting apparatus in accordance with the embodiment of the present invention may include two lighting units. However, the present embodiment is not limited thereto, but may include three or more lighting units.

In this case, the entire light emitting voltages of the respective lighting units may be set to have a difference lower by 20% therebetween, based on the entire light emitting voltage of any one lighting unit.

The plurality of LED groups of the lighting units may be configured to have light emitting voltages at which light emitting points of time are different from each other.

Furthermore, the light emitting voltages of the LED groups of the lighting units, corresponding to each other based on the light emitting sequences, may be set to have a difference of 10% or more, based on the LED group of any one lighting unit.

In the embodiment of the present invention, the non-linearity in change of the entire driving current Irec may be reduced. As the number of lighting units increases, the entire driving current Irec for lighting may have a waveform of which the non-linearity is reduced.

Thus, as the non-linearity of the entire driving current is reduced, current harmonic can be reduced. As a result, power efficiency can be improved.

The lighting apparatus in accordance with the embodiment of the present invention may include lighting units and two or more driving circuits. Each of the lighting units may include a plurality of LED groups which sequentially emit light in response to the change of a rectified voltage, and the two or more driving circuits may share at least a part of the LED groups.

The two or more driving circuits may independently control driving currents for sequential light emissions. At this time, the driving circuits may control the driving currents such that the current change points of the driving currents partially differ from each other.

Furthermore, the number of current change points in the entire driving current corresponding to the sequential light emissions may be set to exceed the number of current change points of the driving circuit having the largest number of current change points among the two or more driving circuits.

The entire driving current may be set to the number of driving currents controlled by the two or more driving circuits, and the number of current change points in the entire driving current may be set to less than the sum of the numbers of current change points in the two or more driving circuits.

Figure 6:
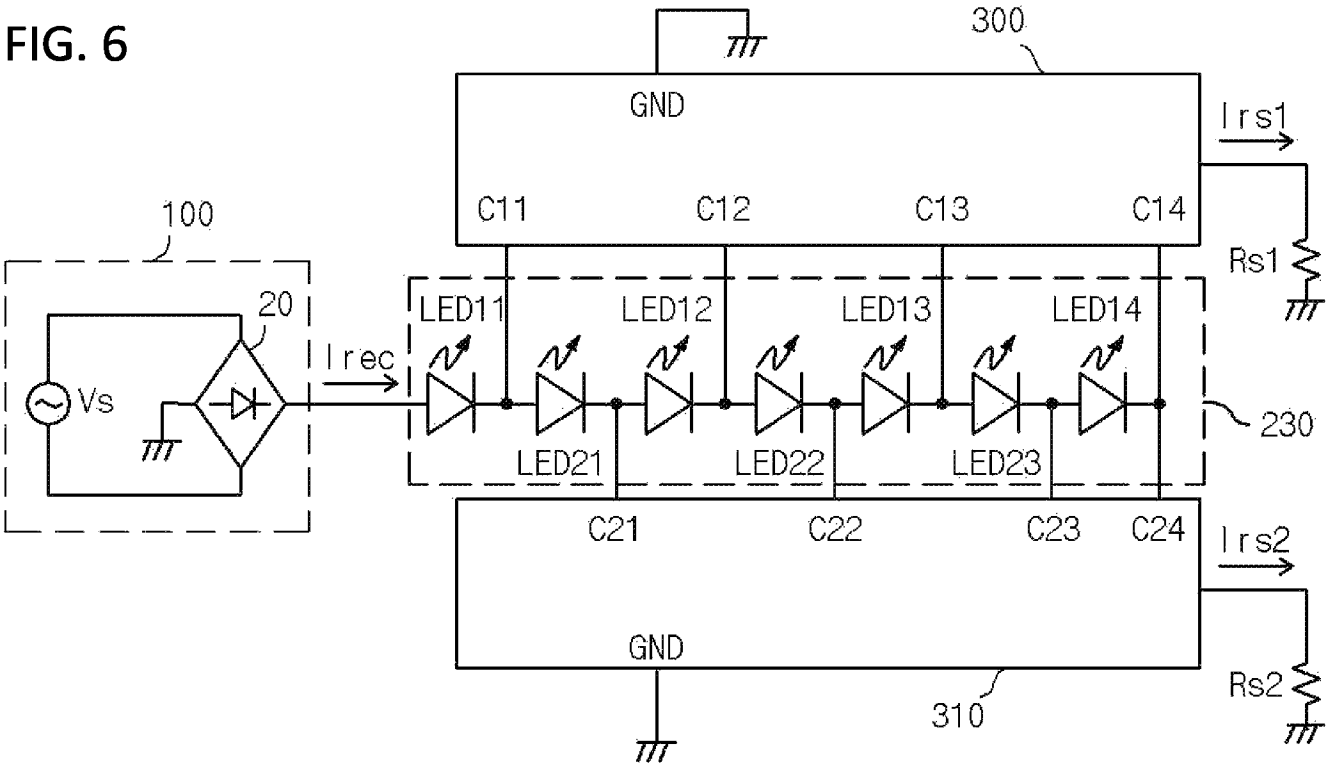
FIG. 6 is a circuit diagram of a lighting apparatus in accordance with another embodiment of the present invention.

The embodiment of the present invention may be configured as illustrated in FIG. 6.

The lighting apparatus in accordance with the embodiment of FIG. 6 may include a power supply circuit 100, a lighting unit 230, driving units 300 and 310, and current sensing resistors Rs1 and Rs2. Since the power supply circuit 100, the driving units 300 and 310, and the current sensing resistors Rs1 and Rs2 have the same configuration as the embodiment of FIG. 1, the duplicate descriptions thereof are omitted herein.

The lighting unit 230 of FIG. 6 may emit light using a rectified voltage provided from a rectifier circuit 20. The entire driving current provided from the rectifier circuit may be represented by Irec, and driving currents divided from the entire driving current Irec and provided to the lighting unit 230 may be represented by Irs1 and Irs2, respectively. The driving currents provided to the lighting unit 230 may be equal to a current flowing through the respective current sensing resistors Rs1 and Rs2.

The lighting unit 230 may include a plurality of LEDs, and the plurality of LEDs may be divided into a plurality of groups and sequentially turned on or off. FIG. 6 illustrates that the lighting unit 230 includes seven LED groups LED11 to LED14 and LED21 to LED23. Each of the LED groups LED11 to LED14 and LED21 to LED23 may include one or more LEDs. In FIG. 6, each of the LED groups LED11 to LED14 and LED21 to LED23 is represented by one symbol, for convenience of description.

The lighting unit 230 may include LED groups which are serially connected in order of LED11, LED21, LED12, LED22, LED13, LED23, and LED14. The LED group LED11 may be defined as the first LED group which emits light in response to the lowest light emitting voltage, and the LED group LED14 may be defined as the last LED group which emits light in response to the highest light emitting voltage.

The lighting apparatus may include one driving circuit configured for the odd-numbered LED groups LED11 to LED14 and the other driving circuit configured for the even-numbered LED groups LED21 to LED23 and the last ELD group LED14. The last LED group LED14 may have an output terminal shared by the two driving circuits. That is, the lighting apparatus in accordance with the embodiment of the present invention may have a structure in which two driving circuits are connected in parallel to the lighting unit 230 and share at least a part of the LED groups.

The driving circuit corresponding to the odd-numbered LED groups LED11 to LED14 of the lighting unit 230 may include the driving unit 300 and the current sensing resistor Rs1, and the driving circuit corresponding to the even-numbered LED groups LED21 to LED23 and the last LED group LED14 of the lighting unit 230 may include the driving unit 310 and the current sensing resistor Rs2.

The driving units 300 and 310 may regulate driving currents, and induce a flow of constant current in response to light emissions of the lighting units 200 and 210. For this operation, the driving units 300 and 310 may perform current regulation for light emission of the LED groups LED11 to LED14 and LED21 to LED24, and provide a current path for light emission with the current sensing resistors Rs1 and Rs2 of which one ends are grounded.

The driving units 300 and 310 may have the same structure or provide the same reference voltage. Furthermore, the current sensing resistors Rs1 and Rs2 may have the same value. For convenience of description, suppose that the reference voltages of the driving units 300 and 310 are equal to each other, and the resistance values of the current sensing resistors Rs1 and Rs2 are equal to each other. However, a designer may differently set the reference voltages of the driving units 300 and 310 or differently set the resistance values of the current sensing resistors Rs1 and Rs2, as long as the sequential emissions are maintained.

In the embodiment of FIG. 6, the LED groups LED11 to LED14 and LED21 to LED23 of the lighting unit 230 may be sequentially turned on or off in response to changes (rises or falls) of the rectified voltage.

A light emitting voltage V14 at which the LED group LED14 emits light may be defined as the voltage at which all of the LED groups LED11, LED21, LED22, LED13, LED23, and LED24 emit light. A light emitting voltage V23 at which the LED group LED23 emits light may be defined as the voltage at which the LED groups LED11, LED21, LED12, LED22, LED13, and LED23 emit light. A light emitting voltage V13 at which the LED group LED13 emits light may be defined as the voltage at which the LED groups LED11, LED21, LED12, LED22, and LED13 emit light. A light emitting voltage V22 at which the LED group LED22 emits light may be defined as the voltage at which the LED groups LED11, LED21, LED12, and LED22 emit light. A light emitting voltage V12 at which the LED group LED12 emits light may be defined as the voltage at which the LED groups LED11, LED21, and LED12 emit light. A light emitting voltage V21 at which the LED group LED21 emits light may be defined as the voltage at which the LED groups LED11 and LED21 emit light. A light emitting voltage V11 at which the LED group LED11 emits light may be defined as the voltage at which only the LED group LED11 emits light.

The driving units 300 and 310 may provide a current path for light emission, when the rectified voltage increases to sequentially reach the light emitting voltages of the respective LED groups LED11 to LED14 and LED21 to LED24.

Figure 5:
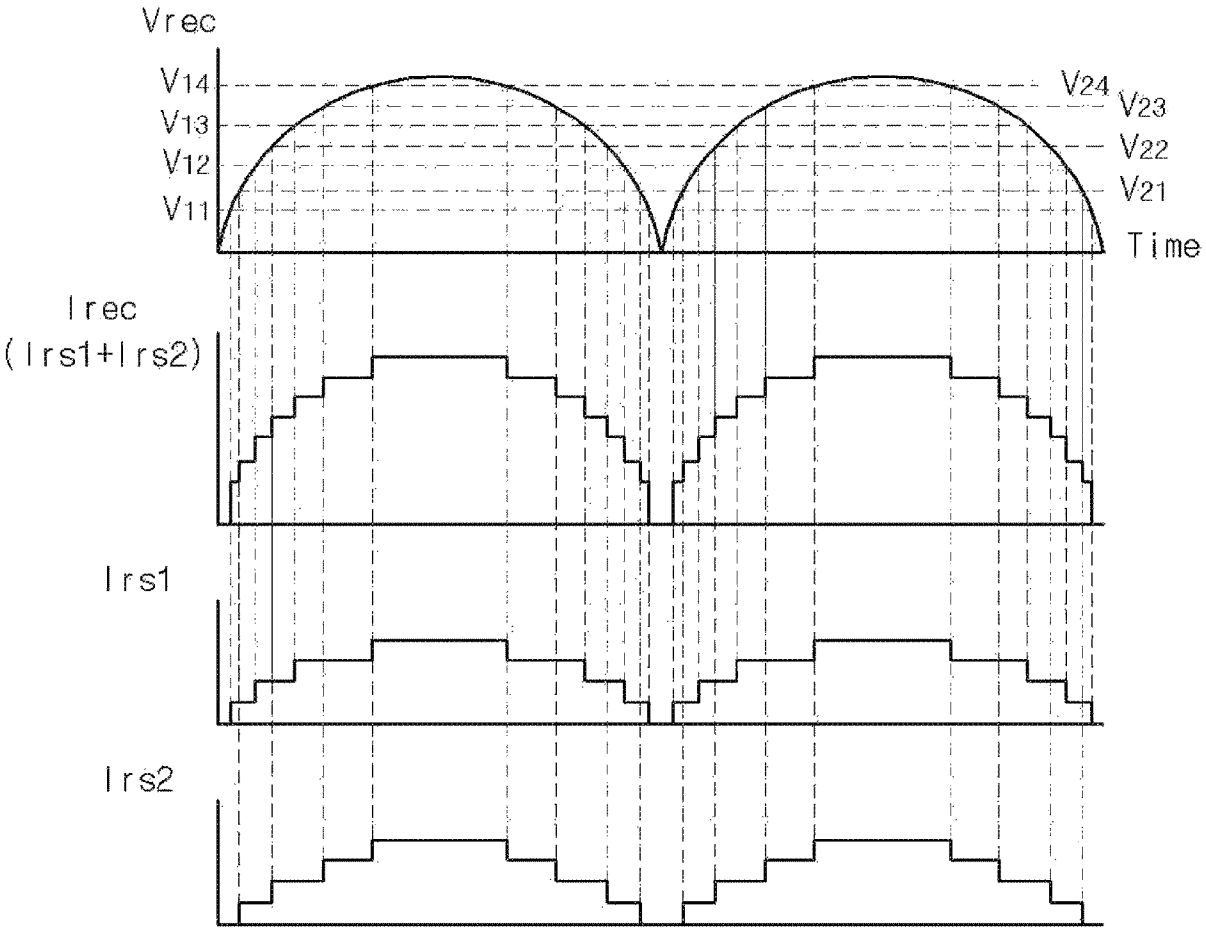
FIG. 5 is a current waveform diagram corresponding to changes of a rectified voltage in the embodiment of FIG. 1.

The operation of the embodiment of FIG. 6 may be described with reference to FIG. 5.

When the rectified voltage is in the initial state, the switching circuits 31 to 34 of the driving units 300 and 310 may maintain a turned-on state because the reference voltages VREF1 to VREF4 applied to the positive input terminals (+) thereof are higher than the sensing voltages of the current sensing resistor Rs1 and Rs2, which are applied to the negative input terminals (−) thereof.

Then, when the rectified voltage rises to reach the light emitting voltages V11, V21, V12, V22, V13, V23, and V14, respectively, the LED groups LED11, LED21, LED12, LED22, LED13, LED23, and LED14 may sequentially emit light.

When the rectified voltage reaches the light emitting voltage V11 such that the LED group LED11 emits light, a current path the switching circuit 31 of the driving unit 300 and the current sensing resistor Rs1 may be provided by in response to the light emission of the LED group LED11. When the rectified voltage reaches the light emitting voltage V21 such that the LED group LED21 emits light, a current path by the switching circuit 31 of the driving unit 310 and the current sensing resistor Rs2 may be provided in response to the light emission of the LED group LED21. When the rectified voltage reaches the light emitting voltage V12 such that the LED group LED12 emits light, a current path by the switching circuit 32 and the current sensing resistor Rs2 of the driving unit 300 may be provided in response to the light emission of the LED group LED12. When the rectified voltage reaches the light emitting voltage V22 such that the LED group LED22 emits light, a current path by the switching circuit 32 of the driving unit 310 and the current sensing resistor Rs2 may be provided in response to the light emission of the LED group LED22. When the rectified voltage reaches the light emitting voltage V13 such that the LED group LED13 emits light, a current path by the switching circuit 33 of the driving unit 300 and the current sensing resistor Rs1 may be provided in response to the light emission of the LED group LED13. When the rectified voltage reaches the light emitting voltage V23 such that the LED group LED23 emits light, a current path by the switching circuit 33 and the current sensing resistor Rs2 of the driving unit 310 may be provided in response to the light emission of the LED group LED23. When the rectified voltage reaches the light emitting voltage V14 such that the LED group LED14 emits light, a current path by the switching circuit 34 of the driving unit 300 and the current sensing resistor Rs2 and a current path by the switching circuit 34 of the driving unit 310 and the current sensing resistor Rs2 may be provided in response to the light emission of the LED group LED14.

Each of the switching circuits 31 to 34 of the driving units 300 and 310 in accordance with the embodiment of the present invention may be turned off when the reference voltage is higher than the sensing voltage, and perform a current regulation operation to regulate a driving current flowing through a current path in response to the change of the rectified voltage until the next LED group emits light after the LED group connected thereto emits light. Furthermore, when the rectified voltage rises over the light emitting voltage V14, the switching circuits 34 of the driving units 300 and 310 may regulate the driving current, and maintain a turn-on state such that the driving current flowing through the current path becomes a predetermined constant current.

When the rectified voltage rises as described above, the LED groups LED11, LED21, LED12, LED22, LED13, LED23, and LED14 may sequentially emit light. In response to the sequential light emissions, the driving currents Irs1 and Irs2 flowing through the respective current paths of the driving units 300 and 310 and the entire driving current Irec provided to the lighting unit 230 may increase in a stepwise manner so as to have a stepped current waveform. The entire driving current Irec may be equal to the sum of the driving currents Irs1 and Irs2 flowing through the respective current paths of the driving units 300 and 310.

After rising to the upper limit level, the rectified voltage may start to fall. When the rectified voltage sequentially falls to the light emitting voltages V14, V23, . . . , V11, the LED groups LED14, LED23, LED13, LED22, LED12, LED21, and LED11 may be sequentially turned off. In response to the sequential turns-off of the LED groups LED14, LED23, LED13, LED22, LED12, LED21, and LED11, the current path may be shifted in the reverse order to the case in which the LED groups LED14, LED23, LED13, LED22, LED12, LED21, and LED11 are turned on. The driving current of the current path may also decrease in a stepwise manner so as to have a stepped current waveform.

In the embodiment of FIG. 6, the LED groups may sequentially emit light in order of LED11, LED21, LED12, LED22, LED13, LED23, and LED14. In response to the sequential light emissions, a current path may be provided by the switching circuit 31 of the driving unit 300 when the LED group LED11 emits light, a current path may be provided by the switching circuit 31 of the driving units 300 and 310 when the LED group LED21 emits light, a current path may be provided by the switching circuit 32 of the driving unit 300 and the switching circuit 31 of the driving unit 310 when the LED group LED12 emits light, a current path may be provided by the switching circuit 32 of the driving units 300 and 310 when the LED group LED22 emits light, a current path may be provided by the switching circuit 33 of the driving unit 300 and the switching circuit 32 of the driving unit 310 when the LED group LED13 emits light, a current path may be provided by the switching circuit 33 of the driving units 300 and 310 when the LED group LED23 emits light, and a current path may be provided by the switching circuit 34 of the driving units 300 and 310 when the LED group LED14 emits light.

In the embodiment of FIG. 6, each of the LED groups LED11 to LED14 and LED21 to LED23 may receive a current path corresponding to light emission through any one or both of the driving units 300 and 310 in response to a change of the rectified voltage. That is, the driving units 300 and 310 may share the LED groups LED11 to LED14 and LED21 to LED23.

Furthermore, a part of the current change points of the driving currents on the current paths provided by the driving units 300 and 310 may be controlled to be different from each other. More specifically, the driving units 300 and 310 may have the same current change point for light emission of the shared LED group LED14, and have different current change points for light emissions of the other LED groups.

In the embodiment of the present invention, the number of current change points of the entire driving current Irec may be set to exceed the number of current change points of the driving unit having the largest number of current change points between the driving units 300 and 310, and set to less than the sum of the numbers of current change points in the driving currents of the driving units 300 and 310.

Thus, in response to the change of one cycle of rectified voltage, many current change points may be formed in the entire driving current Irec, and the non-linearity in change of the entire driving current Irec may be reduced. In the embodiment of the present invention, as the number of LED groups increases, the entire driving current Irec may have a waveform of which the non-linearity is reduced.

More specifically, in the embodiment of FIG. 6, the entire driving current Irec may have seven current change points formed in response to rises of the rectified voltage. Each of the driving currents of the driving units 300 and 310 may have four current change points. Thus, in the embodiment of the present invention, the number of current change points of the entire driving current Irec may be set to exceed the numbers of current change points in the driving currents of the driving units 300 and 310, and set to be smaller than the sum of the numbers of current change points in the driving currents of the driving units 300 and 310.

Thus, as the non-linearity of the entire driving current is reduced, the current harmonic can be reduced. As a result, power efficiency can be improved.

While various embodiments have been described above, it will be understood to those skilled in the art that the embodiments described are by way of example only. Accordingly, the disclosure described herein should not be limited based on the described embodiments.

What is claimed is:

1. A lighting apparatus comprising:

a power supply circuit that generates a rectified voltage;

two or more lighting units each comprising a plurality of LED groups which are connected in series and sequentially emit light in response to changes of the rectified voltage, wherein the two or more lighting units receive in parallel the rectified voltage from the power supply circuit; and two or more driving circuits corresponding to the two or more lighting units, respectively, and configured to regulate driving currents of the two or more lighting units, wherein a first LED group of a first lighting unit of the two or more lighting units and a first LED group of a second lighting unit of the two or more lighting units receive the rectified voltage before other LED groups of the first lighting unit and the second lighting unit, and wherein the first LED group of the first lighting unit comprises a first number of LEDs connected in series and has a first light emitting voltage, wherein the first LED group of the second lighting unit comprises a second number of LEDs connected in series and has a second light emitting voltage, wherein the second number of LEDs in the first LED group of the second lighting unit is greater than the first number of LEDs in the first LED group of the first lighting unit, and the second lighting emitting voltage is greater than the first light emitting voltage, so that the first LED group of the first lighting unit and the first LED group of the second lighting unit have different light emitting voltages and different light emitting points of time, and wherein the first LED group of the second lighting unit emits light between a first light emitting point of time of the first LED group of the first lighting unit and a second light emitting point of time which is before any light emitting points of time of the other LED groups of the first lighting unit.

2. The lighting apparatus of claim 1, wherein the first LED group of the first lighting unit and the first LED group of the second lighting unit emit light in response to a light emitting voltage of the first LED group of the first lighting unit being greater than or less than a light emitting voltage of the second LED group of the second lighting unit by 10% or more.

3. The lighting apparatus of claim 1, wherein an entire light emitting voltage of the first lighting unit of the two or more lighting units is less than an entire light emitting voltage of any one of other lighting units of the two or more lighting units by 20%.

4. The lighting apparatus of claim 1, wherein the two or more lighting units are configured in such a manner that LED groups that have a same light emitting sequence, excluding LED groups which finally emit light, have different light emitting points of time.

5. The lighting apparatus of claim 1, wherein at least LED groups which finally emit light in the two or more lighting units are configured to have a same light emitting point of time.

6. The lighting apparatus of claim 1, wherein each of the two or more driving circuits comprises:

a driving unit configured to compare a sensing voltage to reference voltages corresponding to LED groups connected thereto, and provide a current path; and a current sensing resistor connected to the current path of the driving unit and configured to provide the sensing voltage.

7. A lighting apparatus comprising:

a power supply circuit configured to provide a rectified voltage;

a first lighting unit comprising a plurality of LED groups connected in series and configured to sequentially emit light in response to the rectified voltage;

a second lighting unit connected in parallel with the first lighting unit to the power supply circuit, comprising a plurality of LED groups connected in series and configured to sequentially emit light in response to the rectified voltage, wherein the number of the LED groups of the second lighting unit is equal to the number of the LED groups of the first lighting unit;

a first driving circuit configured to provide a first current path corresponding to the light emission of the first lighting unit; and a second driving circuit configured to provide a second current path corresponding to the light emission of the second lighting unit, wherein a first LED group which first emits light among the plurality of LED groups of the first lighting unit has first light emitting voltage and a first LED group which first emits light among the plurality of LED groups of the second lighting unit has a second light emitting voltage, wherein the second light emitting voltage is greater than the first light emitting voltage, and wherein the first LED group of the second lighting unit emits light between a first light emitting point of time of the first LED group of the first lighting unit and a second light emitting point of time which is before any light emitting points of time of the other LED groups of the first lighting unit.

8. The lighting apparatus of claim 7, wherein the light emitting voltages of the first LED group of the first lighting unit and the first LED group of the second lighting unit have a level difference of 10% or more therebetween.

9. The lighting apparatus of claim 7, wherein the entire light emitting voltage of each of the first and second lighting units is set to have a level difference of less than 20% from the entire light emitting voltage of another lighting unit.

10. The lighting apparatus of claim 7, wherein a second LED group of the first lighting unit that finally emits light during the primary sequential light emission in the first lighting unit has the same emitting point of time as a second LED group of the second lighting unit that finally emits light during the secondary sequential light emission in the second light unit.

11. The lighting apparatus of claim 7, wherein the first group of the first lighting unit and the first LED group of the second lighting units comprise one or more rows, and the number of LEDs connected in series and included in each row of the first LED group of the first lighting unit is different from the number of LEDs connected in series and included in each row of the first LED group of the second lighting unit.

12. The lighting apparatus of claim 7, wherein each of the first and second driving circuits comprises:

a driving unit configured to compare a sensing voltage to reference voltages corresponding to LED groups connected thereto, and provide a current path; and a current sensing resistor connected to the current path of the driving unit and configured to provide the sensing voltage.

13. The lighting apparatus of claim 7, wherein a first driving current corresponding to the light emission of the first lighting unit flows through the first current path of the first driving circuit, a second driving current corresponding to the light emission of the second lighting unit flows through the second current path of the second driving circuit, and the first driving current corresponding to light emission of the first LED group of the first lighting unit has a different amount from the second driving current corresponding to light emission of the first LED group of the second lighting unit.

* * * * *